US009719452B2

(12) United States Patent
Mehr et al.

(10) Patent No.: US 9,719,452 B2
(45) Date of Patent: Aug. 1, 2017

(54) METHOD AND ARRANGEMENT FOR CONTROLLING AN INTERNAL COMBUSTION ENGINE, COMPRISING AT LEAST TWO CONTROL UNITS

(71) Applicant: MTU Friedrichshafen GmbH, Friedrichshafen (DE)

(72) Inventors: Andreas Mehr, Kressbronn (DE); Christoph Hirschle, Kisslegg (DE); Jan Henker, Meckenbeuren (DE); Roger Elze, Karlsruhe (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 80 days.

(21) Appl. No.: 14/764,801

(22) PCT Filed: Jan. 30, 2014

(86) PCT No.: PCT/EP2014/000254
§ 371 (c)(1),
(2) Date: Jul. 30, 2015

(87) PCT Pub. No.: WO2014/117940
PCT Pub. Date: Aug. 7, 2014

(65) Prior Publication Data

US 2016/0010582 A1 Jan. 14, 2016

(30) Foreign Application Priority Data

Feb. 1, 2013 (DE) ..... 10 2013 201 702

(51) Int. Cl.
*F02D 41/22* (2006.01)
*F02D 41/20* (2006.01)
(Continued)

(52) U.S. Cl.
CPC ..... *F02D 41/26* (2013.01); *F02D 41/22* (2013.01); *F02D 41/266* (2013.01);
(Continued)

(58) Field of Classification Search
CPC ..... F02D 41/26; F02D 41/22; F02D 41/3809; F02D 41/266; F02D 41/0082;
(Continued)

(56) References Cited

U.S. PATENT DOCUMENTS 4,748,566 A 5/1988 Sasaki et al.
5,184,300 A * 2/1993 Hara ..... B60R 16/023 123/479
(Continued)

FOREIGN PATENT DOCUMENTS

DE 2945543 C2 5/1981
DE 4113959 a1 11/1992
(Continued)

OTHER PUBLICATIONS

Christiana Seethaler et al: "SIL2 and SIL3 ECU—Safety Controller for Off-Highway" In: "SIL2 and SIL3 ECU—Safety Controller for Off-Highway". Apr. 16, 2007 (Apr. 16, 2007). SAE International. Detroit. Michigan. XP055113915.

*Primary Examiner* — Lindsay Low
*Assistant Examiner* — George Jin
(74) *Attorney, Agent, or Firm* — Lucas & Mercanti, LLP; Klaus P. Stoffel

(57) ABSTRACT

A method for controlling an internal combustion engine, wherein a first engine control device generates a control signal to actuate a function of the engine. A switchover device transmits the control signal of the first control device to the engine to actuate the function of the engine. The first control device transmits a sign-of-life signal which indicates functionality of the control device to the switchover device.
(Continued)

The first engine control device does not transmit the sign-of-life signal or transmits the signal incorrectly if a fault occurs which endangers proper actuation of the function of the engine by the first engine control device. If the sign-of-life signal of the first engine control device is not or is incorrectly received by the switchover device, the switchover device stops transmitting the control signals of the first engine control device and starts transmitting a control signal generated by a second engine control device to the engine to actuate the function of the engine.

19 Claims, 4 Drawing Sheets

(51) Int. Cl.
*F02D 41/26* (2006.01)
*F02D 41/38* (2006.01)
*F02D 11/10* (2006.01)

(52) U.S. Cl.
CPC ..... *F02D 41/3809* (2013.01); *F02D 11/107* (2013.01); *F02D 2041/2058* (2013.01); *F02D 2041/227* (2013.01); *F02D 2400/08* (2013.01)

(58) Field of Classification Search
CPC .. F02D 41/0087; F02D 41/222; F02D 41/221; F02D 2400/08; F02D 37/00; F02D 37/02; F02D 11/105; F02D 11/107; F02D 2041/226; F02D 2041/227; F02D 45/00; G06F 11/0739; G06F 11/1641; G06F 11/2038; G06F 11/16; G06F 11/1608; G06F 11/1629; G06F 11/165
USPC ..... 123/479, 481; 701/29.25, 113, 114, 107; 714/11
See application file for complete search history.

(56) References Cited

U.S. PATENT DOCUMENTS 5,372,112 A * 12/1994 Ohtaka ..... F02D 41/266 123/406.13
5,497,751 A * 3/1996 Ohtake ..... F02B 37/18 123/479
5,605,135 A * 2/1997 Netherwood ..... F02D 41/266 123/479
5,987,365 A * 11/1999 Okamoto ..... F02D 41/266 701/34.3
6,243,627 B1 * 6/2001 Ozeki ..... F02D 41/2487 123/479
6,363,302 B1 3/2002 Haas et al.
6,410,993 B1 6/2002 Giers
6,804,564 B2 10/2004 Crispin et al.
7,013,241 B2 * 3/2006 Yamada ..... F02D 41/0025 701/32.7
9,003,067 B2 4/2015 Barthel et al.
2003/0105537 A1 * 6/2003 Crispin ..... B60W 10/04 700/20
2005/0268890 A1 * 12/2005 Karem ..... F02D 41/0082 123/481
2011/0239992 A1 * 10/2011 Metzdorf ..... F02D 41/266 123/488
2012/0245819 A1 * 9/2012 Graf ..... F02D 41/221 701/99
2012/0292984 A1 * 11/2012 Iwagami ..... B60R 16/00 307/9.1
2013/0158844 A1 * 6/2013 Grahle ..... F02D 45/00 701/114

FOREIGN PATENT DOCUMENTS

DE 19921065 A1 11/2000
DE 3926377 C2 3/2003
DE 10149982 A1 4/2003
DE 102011100982 A1 9/2012
EP 0170920 B1 12/1986
EP 1219489 A2 7/2002
EP 1441264 A1 7/2004
EP 1596055 A1 11/2005
EP 0979189 B1 8/2006
EP 2418580 B1 10/2012
GB 2255422 A 11/1992
WO 2010066477 A1 6/2010

* cited by examiner

METHOD AND ARRANGEMENT FOR CONTROLLING AN INTERNAL COMBUSTION ENGINE, COMPRISING AT LEAST TWO CONTROL UNITS

The present application is a 371 of International application PCT/EP2014/000254, filed Jan. 30, 2014, which claims priority of DE 10 2013 201 702.2, filed Feb. 1, 2013, the priority of these applications is hereby claimed and these applications are incorporated herein by reference.

BACKGROUND OF THE INVENTION

The invention pertains to a method for controlling an internal combustion engine, to a switchover device for use in controlling an internal combustion engine, to an arrangement for controlling an internal combustion engine, and to an internal combustion engine.

Methods and arrangements of the type considered here are known. An engine control unit is provided, which generates at least one control signal to actuate at least one function of the internal combustion engine, typically many or even all of the functions of the internal combustion engine. If, however, a malfunction occurs in the engine control unit, in the sensors functionally connected to the engine control unit, or in the wiring, namely, a malfunction which endangers the proper operation of the internal combustion engine, such a situation cannot be dealt with or at least not dealt with seamlessly or not with the desired reliability.

Especially in the case of internal combustion engines which are configured as common-rail engines, especially as common-rail diesel engines, the manner in which they are built leads to the problem that it is possible to install only a single set of actuators for the required automatic control circuits, such as the circuits for automatic rpm or speed control and/or for automatic high-pressure control for the high-pressure accumulator and especially for the rail of the injection system; that is, a redundant set of actuators cannot be provided. If, therefore, automatic controllers or engine control units offering redundancy to each other are to be provided to deal with a malfunction or a failure of a controller, all of these controllers or control units must be connected to a single set of actuators, namely, to a single actuator system, but they do not have the ability to influence each other. In addition, when responsibility for control is transferred from a first controller to a second controller, the interruption which occurs in the activation of the actuators may not exceed a very short period of time, such as approximately 100 ms, which is the maximum length of time that the internal combustion engine can still operate even under full load without significant speed undershoot and at the same time without an excessive increase in the high-pressure level to the point at which a pressure-relief valve would be triggered. At the same time, it should be possible to install the complete automatic control system with the redundant engine control units on the internal combustion engine itself, that is, it should be engine-mountable.

A switching arrangement for an automatic motor vehicle control system, especially a system for automatic brake control, can be derived from European Patent EP 0 979 189 B1, which comprises two redundant micro processor systems, wherein all of the input data are sent to each micro processor system directly via communications units, which connect the individual micro processor systems to each other. When one of the micro processor systems fails, an emergency function is implemented in such a way that an actuator activation system is connected to the independent micro processor system. For this purpose, the defective micro processor system sends an error signal in the event of a malfunction. This is disadvantageous, because a complete failure of the micro processor system can lead to the situation that not even the error signal itself can be sent. In this case, the malfunction remains unnoticed and cannot be dealt with.

A method for operating a network and a network can be derived from European Patent EP 2 418 580 B1, wherein two redundant control units are provided. One of the control units functions as a primary control unit, wherein the other control unit serves as backup. The primary control unit transmits synchronization signals at regular intervals to the backup control unit. In addition, it sends activity signals at regular intervals to an actuated peripheral device. If a malfunction occurs, the primary control unit stops sending synchronization signals, as a result of which the backup control unit, which is now no longer receiving synchronization signals, checks to see whether the peripheral device has received an activity signal from the control unit within another predetermined period of time. If this is not the case, it is concluded that the primary control unit has failed, whereupon the backup control unit takes over the control responsibility. The disadvantage here is that a two-stage check by the backup control unit is carried out: in a first step, it must determine that no more synchronization signals are being received. In a second step, the peripheral device is checked to determine whether it is still receiving the activity signal from the primary control unit. This procedure is comparatively complicated and is also too slow.

SUMMARY OF THE INVENTION

The invention is based on the goal of creating a method and an arrangement for controlling an internal combustion engine, wherein in particular the failure safety is increased and a seamless switchover to a redundant control system in the event of a malfunction is possible without the need for a complicated checking procedure. The invention is also based on the goal of creating a switchover device for use in the control of an internal combustion engine and an internal combustion engine, wherein in particular the problems cited above are solved and/or the advantages cited above are realized.

The goal is achieved by a method in which. This method is characterized in that a switchover device is provided. For the actuation of at least one function of the internal combustion engine, this device passes along the at least one control signal of the first engine control unit to the engine. The first engine control unit, therefore, transmits its control signal not directly to the internal combustion engine but rather by way of the switchover device. The first engine control unit sends a sign-of-life signal to the switchover device, which indicates the functionality of the first engine control unit. It is provided that the sign-of-life signal is sent by the first engine control unit continuously or periodically, i.e., uninterruptedly or at intervals, to the switchover device. If an error or a malfunction occurs, wherein the proper actuation of the at least one function of the internal combustion engine by the first engine control unit is put at risk, the first engine control unit does not transmit the sign-of-life signal or does not transmit it correctly to the switchover device, so that it is no longer received or no longer correctly received by it. The first engine control unit preferably stops transmitting the sign-of-life signal. In this case, the switchover device stops passing along the control signal of the first engine control unit to the internal combustion engine, and it begins passing along the control signal generated by the second engine control unit to the internal combustion engine for actuation of the at least one function of the engine. The switchover device therefore switches the control of the internal combustion engine from the first engine control unit to the second engine control unit in the event of a malfunction, wherein this can proceed seamlessly. Because, in the event of a malfunction, the first engine control unit does not send an error signal but rather stops sending the sign-of-life signal or stops sending it correctly, wherein it preferably stops sending the sign-of-life signal, even the complete failure of the first engine control unit in particular is noticed by the switchover device, so that a seamless switchover to the second engine control unit is possible. There is no need for a two-stage check, because the second engine control unit does not actively have to check for the failure of the first engine control unit if no data are being transmitted; on the contrary, the switchover device reacts immediately to the absence or incorrect reception of the sign-of-life signal of the first engine control unit by switching over to the second engine control unit, without any further measures being taken. The method is therefore very simple and reliable.

In one embodiment of the method, it is possible for the sign-of-life signal to be identical to the at least one control signal. In another embodiment of the method, the sign-of-life signal is preferably a signal generated independently by the control signal and sent to the switchover device. In yet another embodiment of the method, the sign-of-life signal is superimposed on the control signal, or the sign-of-life signal is a property of the control signal, such as the correct timing of a pulse-width-modulated control signal. The switchover device recognizes that the sign-of-life signal is not being received or is no longer being correctly received either when the control signal itself is absent or when the property of the control signal representing the sign-of-life signal is no longer present, such as the timing of the pulse-width-modulated signal, in particular when the chronological sequence of the slopes of that signal is no longer correctly detected.

Within the scope of the method, a pulse-width-modulated signal is generated by the first engine control unit as the control signal and/or as a separate sign-of-life signal of a software program. This deviates from the conventional way of generating a pulse-width-modulated signal insofar as an electronic element such as a comparator or a microcontroller is typically used, which merely is actuated as needed by the software. In the present case, however, it is preferred that the pulse-width-modulation be generated by the software itself, i.e., that, therefore, in a program for generating the signal, an algorithm is provided by means of which the chronological sequence of pulse widths representing the signal is calculated and generated. A solution of this type is usually believed to be disadvantageous, because it is difficult or nearly impossible to generate a defined pulse-width-modulated signal on the basis of a program. In the method under discussion here, however, this weakness is effectively utilized, in that the pulse-width-modulated signal is detected in the switchover device by suitable hardware and checked for deviations in its timing. If the software of the first engine control unit is malfunctioning, it is no longer able to time the pulse-width-modulated signal properly. This is recognized in the switchover device as the failure to receive the sign-of-life signal correctly, so that the switchover device then switches over to the second engine control unit. By means of the software-generated pulse-width-modulated signal, therefore, it is possible to include even malfunctions of the software of the first engine control unit in the monitoring.

Errors which put at risk the proper actuation of the at least one function of the internal combustion engine by the first engine control unit can occur in many different forms. For example, it is possible for an error to occur in the sensors functionally connected to the first engine control unit, so that correct measurement values are not being sent to the engine control unit for the actuation of the internal combustion engine. It is also possible for the functional connection between the first engine control unit and the sensors in question to be broken. It is also possible for the functional connection between the first engine control unit and the switchover device, in particular the cabling between them, to be interrupted. In this case, the sign-of-life signal of the first engine control unit will no longer be received by the switchover device. Finally, it is possible for a hardware-caused or software-caused malfunction which puts at risk the proper actuation of the internal combustion engine to occur in the engine control unit. In particular it is possible for the first engine control unit to fail completely. In this case as well, the sign-of-life signal will obviously no longer be transmitted to the switchover device.

It is therefore necessary to distinguish between errors or malfunctions which necessarily lead to the failure to transmit the sign-of-life signal to the switchover device as a result of the error or malfunction itself, an example of this being a broken functional connection, and errors or malfunctions which are actively recognized by the first engine control unit, whereupon the first engine control unit either stops sending the sign-of-life signal completely or stops sending the sign-of-life signal correctly. In the cases in which the transmission of the sign-of-life signal necessarily fails, what happens in effect is an automatic switchover to the second engine control unit. In other cases, the first engine control unit itself, by stopping to transmit the sign-of-life signal or by stopping to transmit it correctly, transfers the actuation to the second engine control unit by way of the switchover device.

The first engine control unit preferably does not stop transmitting or stop correctly transmitting the sign-of-life signal when any error or any malfunction at all occurs but rather only when an error of malfunction occurs which truly endangers the proper actuation of the at least one function of the internal combustion engine, i.e., which makes it no longer possible, for example, to maintain certain operating points, to remain below certain exhaust gas limit values, or even to operate safely. The first engine control unit therefore preferably analyzes the errors or malfunctions which it has detected with respect to their potential for putting at risk the proper actuation of the internal combustion engine. A decision criterion is preferably used, on the basis of which the first engine control unit decides whether or not to stop transmitting or to stop correctly transmitting the sign-of-life signal. In this decision-making process, it is possible to include in particular, as a criterion, whether or not the first engine control unit is receiving a sign-of-life signal from the second engine control unit. To this end, it is preferably provided in one embodiment of the method that the second engine control unit also generates a sign-of-life signal, which it transmits at least to the first engine control unit. It is then possible for the first engine control unit to stop transmitting or to stop correctly transmitting the sign-of-life signal only when it is correctly receiving the sign-of-life signal of the second engine control unit.

An actuation of the at least one function of the internal combustion engine preferably involves the control and/or automatic control of at least one variable. The engine control units are therefore preferably configured as automatic controllers.

A method is preferred which is characterized in that the first engine control unit transmits data necessary for actuation of the at least one function of the internal combustion engine a single time, preferably while the internal combustion engine is being started or immediately thereafter, to the second engine control unit. In this case, the data present at the beginning of the operation of the internal combustion engine are also available to the second engine control unit, so that it can take over responsibility for actuation in the event of an error.

Alternatively, it is preferred that the first engine control unit transmit the data necessary for the actuation of the at least one function of the internal combustion engine periodically to the second engine control unit. The transmission thus occurs preferably at predetermined time intervals, wherein a first transmission is made preferably while the internal combustion engine is being started or immediately thereafter. In this embodiment of the method, the second engine control unit is updated to the current status at regular intervals, so that any changes in the data are also transmitted to the second engine control unit and are then available, in the event of an error, for the actuation or automatic control of the internal combustion engine.

As another alternative, it is preferred that the data necessary for the actuation of the at least one function of the internal combustion engine be transmitted as needed to the second engine control unit. In particular, these data are transmitted to the second engine control unit after there has been a change in the data. In this embodiment, too, it is preferred that the data be transmitted to the second engine control unit or stored in it the first time while the internal combustion engine is being started or immediately thereafter. A second transmission is then made preferably as needed, i.e., after there has been a change in the data. This guarantees that the data present in the second engine control unit are always up to date, so that, in the event of an error, the at least one function of the internal combustion engine can continue to be automatically controlled or actuated seamlessly by the second engine control unit on the basis of the current data necessary for the actuation, control, or automatic control.

Alternatively, it is preferred that the data necessary for the actuation of the at least one function of the internal combustion engine be stored from the very beginning in the second engine control unit, wherein, in particular, they are maintained permanently at predetermined values. These data are called up when the actuation of the at least one function of the internal combustion engine is switched over to the second engine control unit. This offers the advantage that there is no need for any communication between the first and the second engine control units.

The term "call up" according to a first alternative means that the parameters corresponding to the data are initialized with the stored values upon the takeover of the actuation, wherein the parameters can comprise previously undefined and/or changeable values. According to a second alternative, the term "call up" means a procedure according to which the parameters are maintained at the stored values until the second engine control unit takes over the actuation. From this point on, the parameters are released, so that they can be changed during operation and in particular can be adapted to changing operating conditions.

Especially in an embodiment of the method in which the first and the second engine control units do not communicate with each other, it is advantageous for the second engine control unit to recognize when responsibility for the actuation of the at least one function is switched to it.

The data necessary for the actuation of the at least one function preferably comprise in particular load points, engine map points, and/or complete characteristic diagrams which are necessary for the control of the internal combustion engine, in particular for the actuation of the at least one function of that engine.

The first and second engine control units are preferably configured as automatic controllers, which, during the automatic control process, take into account integral action elements or integral components. Such integral components are then preferably also included in the data necessary for the actuation of the at least one function. Because the second engine control unit sees an open control circuit as long as the switchover device has not switched the actuation of the internal combustion engine over to it, the integral components in the second engine control unit deviate increasingly over time from the integral components in the first engine control unit. This can lead to problems when there is a switchover to the second engine control unit, especially because the integral components do not change quickly but rather only over a certain period of time, which means that there cannot be a rapid recovery after the switchover. To avoid such problems, it is provided in a preferred embodiment of the method that the second engine control unit recognizes when the switchover device switches the actuation of the internal combustion engine over to it, wherein in this case it initializes the integral components to previously determined values, in particular to values which have been established by test bench experiments and/or by experience, and which are stored in the second engine control unit. In an alternative embodiment of the method, it is provided that the integral components with the previously determined values are stored in the second engine control unit as long as the responsibility for control has not yet been switched over to the second engine control unit. In another embodiment of the method, the integral components are transmitted from the first engine control unit to the second engine control unit, wherein one of the previously described alternatives for the transmission of the data necessary for the actuation of the at least one function of the internal combustion engine is selected. To this extent, reference is made herewith to these alternatives. In a preferred embodiment of the method, it is possible in particular for the integral components to be transmitted periodically from the first engine control unit to the second engine control unit, wherein, if the transmission fails, the second engine control unit makes use of the previously determined, stored values.

Another preferred method is characterized in that the second engine control unit transmits a sign-of-life signal indicating its functionality to the switchover device, wherein this is done continuously or periodically. It is therefore possible to identify an error or a malfunction in the second engine control unit or possibly even its complete failure.

Alternatively or in addition, the second engine control unit preferably transmits a sign-of-life signal to the first engine control unit. In this case, it is possible—as previously described—for the first engine control unit to use the correct reception of the sign-of-life signal of the second engine control unit as a criterion for the active termination of the transmission or of the correct transmission of its own sign-of-life signal.

It is possible for the assignment of the sign-of-life signal to the first or to the second engine control unit to be encoded in the signals themselves. Alternatively, it is possible for the sign-of-life signals to be identical but received at different inputs of the switchover device, wherein the inputs are assigned to the first or to the second engine control unit. In either case, it is guaranteed that the sign-of-life signals can be properly assigned to the engine control unit from which it has been transmitted.

In this context a method is preferred which is characterized in that the switchover device begins to pass the control signals of the second engine control unit on to the internal combustion engine along only when, first, the sign-of-life signal of the first engine control unit is no longer or is no longer correctly being received and, second, simultaneously, the sign-of-life signal of the second engine control unit is being correctly received. The switchover of the actuation of the internal combustion engine to the second engine control unit is thus executed only when, first, there is in fact a malfunction in the area of the first engine control unit and, second, when it is verified that the second engine control unit is functional. If, however, it is determined that both engine control units are not functioning properly or have failed, preferably other measures are taken to ensure the safe operation of the internal combustion engine, or, under certain circumstances, the engine is turned off.

A method is also preferred which is characterized in that the switchover device switches the responsibility for actuating the at least one function of the internal combustion engine back to the first engine control unit when the sign-of-life signal of the second engine control unit is no longer being received, wherein, simultaneously, the sign-of-life signal of the first engine control unit is being received again. This embodiment is based on the idea that the malfunction in the first engine control unit is possibly of a temporary sort, i.e., that it no longer occurs after a certain period of time. In this case, the first engine control unit preferably begins again to transmit its sign-of-life signal, which is received by the switchover device. If, now, a malfunction occurs in the area of the second engine control unit, which is actuating the internal combustion engine, this second unit preferably stops transmitting or stops correctly transmitting its sign-of-life signal, wherein this is detected by the switchover device. In the event that the first engine control unit has become functional again and its sign-of-life signal is being correctly received by the switchover device, the switchover device switches back to the first engine control unit, so that this first unit again takes over the job of actuating the at least one function of the engine, preferably the control or automatic control of the entire internal combustion engine. It is obvious that the method preferably can be continued in this way, so that, precisely upon the occurrence of temporary malfunctions, there can be multiple changes back and forth between the two engine control units.

A method is also preferred which is characterized in that the second engine control unit continuously generates at least one control signal during operation of the internal combustion engine, wherein it also does this at a time when this control signal is not being passed along by the switchover device to the engine. This means that the second engine control unit does not start generating control signals only after it has taken over the job of actuating the at least one function of the engine. Instead, the second engine control unit begins to generate control signals independently of the first engine control unit as soon as the engine is started, so that at all times—except in the event of a malfunction—control signals are generated redundantly by both engine control units, wherein the switchover device, however, passes only the control signals of one of the engine control units along to the engine. In this way it is possible for the switchover device to switch the control especially quickly and seamlessly to the second engine control unit, because the second control unit does not have to go through the process of starting to generate control signals from the beginning.

This procedure is also preferably used so that the second engine control unit can recognize whether or not it is responsible for the actuation of the internal combustion engine, i.e., whether or not the switchover device has switched from passing the control signals of the first engine control unit to the engine to passing along the control signals of the second control unit. For this purpose, the second engine control unit preferably generates a voltage, on the basis of which a current flows when the second engine control unit is actuating the at least one function of the engine. If, however, the control signal of the second engine control unit is not being passed along by the switchover device to the engine, no current flows. The second engine control unit monitors the flow of current and preferably determines whether or not the current exceeds a predetermined threshold value, such as 0 A or 1 A. If this is not the case, i.e., if the measured current is below the threshold value, the at least one control signal of the second engine control unit is not passed along by the switchover device to the internal combustion engine at that time. If, however, the measured current is above the predetermined threshold value, the second engine control unit recognizes that the actuation of the at least one function of the engine has been transferred to it by the switchover device. This is essential especially in conjunction with the correct initialization of integral components of the second engine control unit configured as an automatic controller, so that the integral components can be correctly initialized at the proper time, or so that the second engine control unit can promptly stop maintaining the integral components at the previously determined values when it takes over the job of controlling the engine.

Alternatively, it is possible for the second engine control unit not to generate any control signals as long as it is not being used for actuation by the switchover device. In this case, the switchover device, when switching over to the second engine control unit, transmits to the second control unit a signal which causes it to start generating control signals, which are then passed along by the switchover device to the internal combustion engine.

A method is preferred which is characterized in that, by means of the first or the second engine control unit, an actuator system of the engine is controlled or automatically controlled. In particular, the actuator system comprises at least one injector and/or at least one suction throttle of the engine. In particular, the engine control unit currently being used to control or automatically to control the engine controls or automatically controls all of the injectors and/or suction throttles of the engine. In an especially preferred embodiment of the method, it is provided that the engine control unit controls or automatically controls all of the functions of the engine, in particular controls and/or automatically controls the internal combustion engine as a whole. To this extent, the engine control units can also be called "engine controllers".

A method is preferred in particular in which the first or the second engine control unit automatically controls the rpm's or the speed of the internal combustion engine by activating at least one injector of the engine as an actuator. Alternatively or in addition, it is preferred that the first or the second engine control unit automatically controls the pressure in a high-pressure accumulator of a fuel injection device, especially the rail pressure in the rail of a common-rail diesel engine, by activating a suction throttle of a high-pressure pump as the actuator. It has been found that, for the activation of the suction throttle, it is necessary for a current to be flowing through it.

A method is preferred in which the second engine control unit monitors a continuously generated control signal in order to detect whether or not it is actuating the at least one function of the internal combustion engine. The second engine control unit preferably initializes parameters, especially integral components, for the actuation of the at least one function of the engine with stored values when it detects that it is actuating the at least one function of the engine. Alternatively or in addition, it releases previously determined, retained values of the parameters for variation when it detects that it is actuating the at least one function of the engine.

In this context a method is preferred in which the second engine control unit generates a voltage, on the basis of which a current flows, when it is actuating the at least one function of the internal combustion engine, wherein if no current flows then the control signal is not being passed along by the switchover device to the internal combustion engine. The second engine control unit preferably monitors whether or not a current is flowing. It monitors in particular whether or not the current exceeds a predetermined threshold value.

In a preferred embodiment of the method, the activation of the suction throttle according to the previously described procedure is used in particular to make it possible for the second engine control unit to recognize whether or not the responsibility for control has been transferred to it. For this purpose, the second engine control unit preferably actuates the suction throttle continuously, thus generating in particular a voltage, wherein no current flows from the second engine control unit through the suction throttle when the control unit is not functionally connected to the internal combustion engine by way of the switchover device. If, however, the switchover device switches over to the second engine control unit, then current flows from this second control unit through the suction throttle; this current can be measured by the second engine control unit, and in particular it can be determined whether or not this current is above a predetermined threshold value. In this case, the second engine control unit preferably recognizes that the switchover device has transferred the actuation of the internal combustion engine to it.

The goal is also achieved by a switchover device for use in the control of an internal combustion engine, especially for implementing a method according to one of the previously described embodiments. The switchover device is characterized in that it can be functionally connected to a first engine control unit and to a second engine control unit and also to an internal combustion engine. The switchover device is configured in such a way that it can pass along at least one control signal of the first engine control unit or of the second engine control unit to the internal combustion engine. The pass-along transmission by the switchover device can be switched over from the first engine control unit to the second engine control unit. The switchover device is thus configured in such a way that it is always transmitting either the at least one control signal of the first engine control unit or the at least one control signal of the second engine control unit to the internal combustion engine, wherein it can switch the transmission over from the first engine control unit to the second engine control unit. The switchover device is also configured so that it can receive a sign-of-life signal from the first and/or from the second engine control unit. The switchover device is preferably configured so that it stops transmitting the at least one control signal of the first engine control unit to the internal combustion engine and begins transmitting the at least one control signal of the second engine control unit to the internal combustion engine when the sign-of-life signal of the first engine control unit is not being received or is not being received correctly by the switchover device.

The switchover device preferably comprises a detection means, which is configured in such a way that the detection means can determine whether or not the sign-of-life signal is being received. The switchover device preferably also comprises an evaluation means, which is configured in such a way that it can evaluate the correctness of the sign-of-life signal being received. It is possible in particular here for the evaluation means to be configured so that it can check the timing of the pulse-width-modulated signal to determine whether or not this is correct, in particular whether or not it satisfies previously determined criteria.

A switchover device is also preferred which is characterized in that it comprises at least one switch. This switch is preferably configured as an electromechanical switch, especially as a relay. It is especially preferable, however, for the switch to be configured as a semiconductor switch. The use of semiconductor switches in the switchover device is advantageous, because this in itself guarantees that the maximum interruption in the transmission of control signals to the internal combustion engine is so short that the internal combustion engine can continue to operate without significant speed undershoot and without an excessive increase in the high pressure even under full load, wherein the interruption is preferably in a range below 100 ms. Semiconductor switches can be switched very rapidly, and at the same time the switchover device takes up only a small amount of space, so that it can be easily installed on the internal combustion engine.

Finally, a switchover device is preferred which is characterized in that it comprises an anti-interrupt means, by means of which at least one control signal can be passed along from the switchover device to the internal combustion engine even during a switchover between the engine control units. A switchover device of this type is preferably provided to operate with a control signal representing the flow of current through an actuator. So that there is no impairment to the function of the internal combustion engine, this actuator should not be interrupted during a switchover. The anti-interrupt means is preferably configured as a flyback element, across which it is possible to maintain a flow of current in the known manner when the switchover from the first engine control unit to the second engine control unit occurs. For this purpose, the flyback element preferably comprises at least one diode. The anti-interrupt means, in particular the flyback element, is even more preferably configured in such a way that it does not affect the flow of current through the actuator during normal operation, so that the current measurement in the first or second engine control unit is not falsified.

The description of the method on the one hand and of the switchover device on the other hand are to be understood as complementary to each other. In particular, a switchover device is preferred which is characterized by at least one feature which is adapted to, or necessary for, the implementation of at least one method step which has been described in conjunction with the method. In the same way, an embodiment of the method is preferred which is characterized by at least one step which is the result of at least one feature described in conjunction with the switchover device.

The goal is also achieved by an arrangement for controlling an internal combustion engine, which arrangement is in particular configured to implement a method according to one of the previously described embodiments. It comprises a first engine control unit, a second engine control unit, and a switchover device, in particular a switchover device according to one of the previously described exemplary embodiments. The arrangement is characterized in that the first the second engine control units are configured in such a way that they can generate control signals by means of which at least one function of the internal combustion engine can be actuated, preferably the entire internal combustion engine can be controlled and/or automatically controlled. The first and second engine control units can be functionally connected to an internal combustion engine by way of the switchover device, in order that these control signals can be sent to the engine. In particular, the first and second engine control units are preferably functionally connected to the switchover device in such a way that the control signals of the first and second engine control units can be passed along by the switchover device to the internal combustion engine. The switchover device is configured in such a way that it can switch the transmission of the control signals over, so that, as desired, only the control signals of the first engine control unit or only those of the second engine control unit are passed along to the internal combustion engine. The first engine control unit is configured in such a way that it can generate and send a sign-of-life signal indicating its functionality, wherein at the same time it is configured in such a way that the generation and/or transmission of the sign-of-life signal or the correct generation and/or transmission of that signal can be stopped, wherein the first engine control unit can in particular actively stop generating and/or transmitting or stop correctly generating and/or transmitting the sign-of-life signal when an error or a malfunction occurs which puts at risk the proper actuation of the at least one function of the internal combustion engine by the first engine control unit. In particular the first engine control unit is preferably configured in such a way that the generation and/or transmission of the sign-of-life signal is stopped when the first engine control unit completely fails. The first engine control unit is functionally connected to the switchover device in such a way that its sign-of-life signal can be received by the switchover device. The switchover device is configured or set up in such a way that it stops passing along the at least one control signal of the first engine control unit to the internal combustion engine and begins passing along the at least one control signal of the second engine control unit to the internal combustion engine when the sign-of-life signal of the first engine control unit is not being received or is not being correctly received. In the event of an error, therefore, the switchover device can transfer the responsibility for actuating the at least one function of the internal combustion engine from the first engine control unit to the second engine control unit. This can occur seamlessly, without causing any interference with the operation of the internal combustion engine. In particular, the switchover takes place promptly, so that the internal combustion engine does not immediately stop operating as a result of the malfunction, i.e., the internal combustion engine therefore does not stall out.

The first engine control unit is preferably functionally connected to the second engine control unit in such a way that all of the data necessary for the actuation of the at least one function of the internal combustion engine, in particular load points, engine map points, entire characteristic diagrams and/or integral components, can be transmitted from the first engine control unit to the second engine control unit.

The switchover device is preferably configured as an electronic "box", which comprises inputs for connecting it to the first and second engine control units and at least one output for connecting it to the internal combustion engine.

An arrangement is preferred which is characterized in that the first engine control unit and the second engine control unit are functionally connected to each other by a fieldbus. The fieldbus is preferably configured as a CAN (Controller Area Network) bus. This is an especially simple and elegant way of functionally connecting the engine control units to each other for data transfer.

Finally, an arrangement is preferred which is characterized in that the second engine control unit is configured in such a way that it can generate a sign-of-life signal indicating its functionality, wherein it can transmit the sign-of-life signal continuously or periodically. It is functional connected to the switchover device and/or to the first engine control unit in such a way that the sign-of-life signal can be received by the one and/or by the other. The switchover device is preferably configured in such a way that it transfers responsibility for the actuation of the at least one function of the internal combustion engine from the first to the second engine control unit only when the sign-of-life signal of the first engine control unit is not being received or is not being received correctly, wherein at the same time the sign-of-life signal of the second engine control unit is being received correctly. If, however, neither of the sign-of-life signals is being received or is being received correctly, other measures can be taken to guarantee the safe operation of the internal combustion engine or to turn it off in a controlled manner. The actuation of the at least one function of the internal combustion engine can also be switched back to the first engine control unit in the event of a malfunction of the second engine control unit in the case that the malfunction of the first engine control unit was only temporary and no longer exists, as previously described in conjunction with the method.

With respect to the arrangement, exemplary embodiments are preferred which comprise at least one feature which is prescribed by at least one step, preferably by a combination of steps, described within the scope of the method. With respect to the method, exemplary embodiments are preferred in which at least one method stop is carried out which is prescribed by at least one feature of the arrangement, preferably by combinations thereof. To this extent, the descriptions of the method and of the arrangement are not to be understood in isolation from each other but rather are to be seen as complementary to each other, wherein method features can be derived from the description of the arrangement and device features can be derived from the description of the method. The same is true in analogous fashion for the method and the switchover device and for the switchover device and the arrangement.

The goal is also achieved, finally, by an internal combustion engine having an arrangement according to one of the previously described exemplary embodiments. As a result, the advantages which have already been explained in conjunction with the method, the switchover device, and the arrangement are realized.

Preferred is an internal combustion engine which is characterized in that the internal combustion engine is configured as a common-rail engine, especially as a diesel engine or as a gasoline engine. Precisely in this case, the first and the second engine control units are preferably provided to carry out automatic high-pressure control with a suction throttle as actuator and also to carry out automatic rpm or speed control with at least one injector as actuator. The internal combustion engine is preferably configured for use in a submarine or in a fire-extinguishing pump.

A fire-extinguishing pump which is characterized by an internal combustion engine according to one of the previously described exemplary embodiments is also preferred.

A submarine which is characterized by an internal combustion engine according to one of the previously described exemplary embodiments is also preferred.

Both fire-extinguishing pumps and submarines must satisfy extremely high safety standards, especially with respect to the failure of the internal combustion engine, so that here, in an especially significant way, the advantages of the method, of the switchover device, of the arrangement, and of the internal combustion engine are realized.

The use of an internal combustion engine according to one of the previously described exemplary embodiments within the scope of an application which must satisfy very strict safety criteria with respect to the failure of the internal combustion engine such as use in a submarine or in a fire-extinguishing pump is also preferred.

BRIEF DESCRIPTION OF THE DRAWING

The invention is explained in greater detail below on the basis of the drawings.

DETAILED DESCRIPTION OF THE INVENTION

Figure 1:
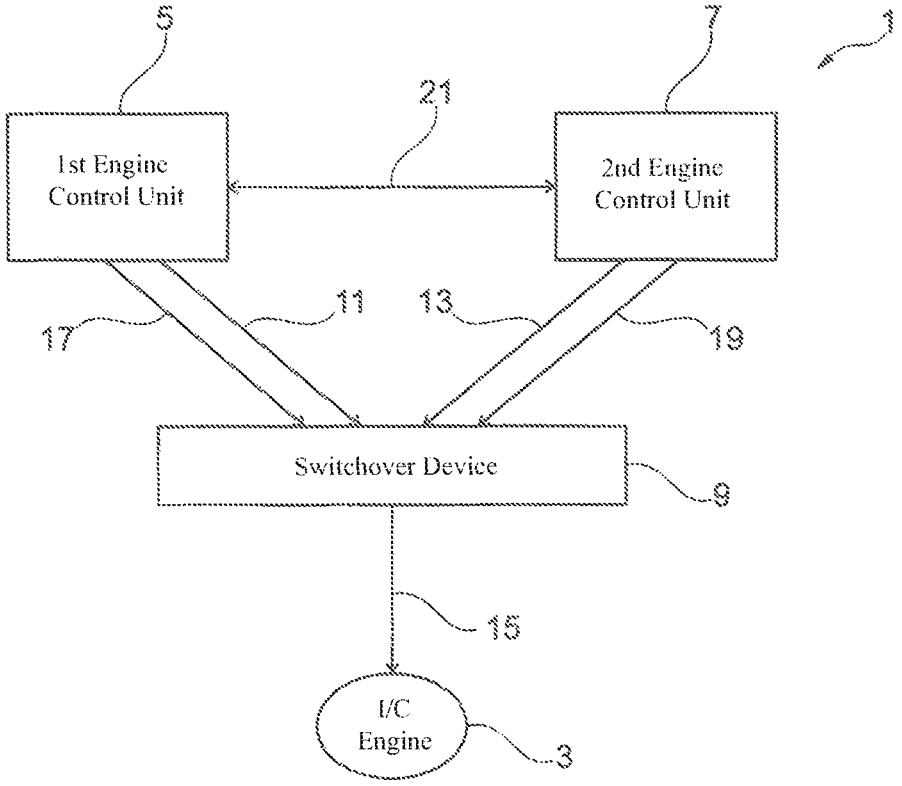
FIG. 1 shows a schematic diagram of an exemplary embodiment of an arrangement for controlling an internal combustion engine.

FIG. 1 shows a schematic diagram of an exemplary embodiment of an arrangement 1 for controlling an internal combustion engine 3. The arrangement 1 comprises a first engine control unit 5, a second engine control unit 7, and a switchover device 9.

The first engine control unit 5 and the second engine control unit 7 are able to generate control signals, which serve to actuate at least one function of the internal combustion engine, preferably to control and/or to automatically control a plurality of functions or the entire internal combustion engine. The first engine control unit 5 is functionally connected by a functional connection 11 to the switchover device 9, the second engine control unit 7 being connected to it by a functional connection 13, these connections allowing the control signals from each control unit to be transmitted to the switchover device. The switchover device 9 is functionally connected to the internal combustion engine 3 by a third functional connection 15 for passing along the control signals to the engine. At any one time, the switchover device 9 passes along the control signals of only one of the two engine control units 5, 7 to the internal combustion engine 3.

In the exemplary embodiment shown here, each of the engine control units 5, 7 generates a sign-of-life signal, which indicates its functionality, wherein, in the case of the first engine control unit 5, it is transmitted by way of a fourth functional connection 17 and, in the case of the second engine control unit 7, by way of a fifth functional connection 19, to the switchover device 9.

So that the second engine control unit 7 has available all of the data necessary for actuation of the at least one function of the internal combustion engine 3, in particular for its control or automatic control, the first engine control unit 5 is preferably functionally connected to the second engine control unit 7 by way of a fieldbus 21, so that the data can be transmitted from the first engine control unit 5 to the second engine control unit 7 a single time, namely, when the internal combustion engine 3 is being started or immediately thereafter, periodically, or as needed, in particular after a change in the data.

In the exemplary embodiment shown here, it is provided that the first engine control unit 5 is used as the primary control unit. After the internal combustion engine 3 has been started, the switchover device 9 passes along the control signals generated by the first engine control unit 5 to the internal combustion engine 3 as long as it, i.e., the switchover device, is receiving the sign-of-life signal from that control unit. At the same time, the second engine control unit 7 also preferably generates all of the control signals necessary for actuation, but the switchover device 9 does not pass them along to the internal combustion engine 3. The second engine control unit 7, in the exemplary embodiment shown there, is used as a backup control unit, which is redundant to the first engine control unit 5 and, in the event of an error, can take over the job of actuating the at least one function of the internal combustion engine 3 or the automatic control of that function.

The way in which the arrangement 1 functions will now be explained on the basis of the flow chart of FIG. 2, which represents a schematic diagram of a preferred embodiment of the method for controlling the internal combustion engine 3. At regular intervals, i.e., preferably after predetermined time intervals, or continuously, the first engine control unit 5 checks for the presence of an error or malfunction which puts at risk the proper actuation of the at least one function of the internal combustion engine 3. As long as no such error or malfunction is present, the first engine control unit 5 generates the sign-of-life signal correctly and sends this signal to the switchover device 9 in a step S2. The switchover device 9 passes along the control signals of the first engine control unit 5 to the internal combustion engine 3, so that the engine, in a step S3, is controlled and/or automatically controlled by the first engine control unit 5 at least with respect to the at least one function.

If, however, an error or a malfunction does occur, or if the first engine control unit 5 fails completely, the control unit stops generating and/or transmitting the sign-of-life signal or stops correctly generating and/or transmitting it in a step S10. The sign-of-life signal of the first engine control unit 5 is then no longer received or is no longer received correctly by the switchover device 9, as a result of which, in a step S11, the switchover device is caused to stop passing along the control signals of the first engine control unit 5 to the internal combustion engine 3 and instead to begin passing along the control signals generated and transmitted by the second engine control unit 7 to the internal combustion engine 3 to control and/or automatically to control it at least with respect to the at least one function. From that point on, the second engine control unit 7, in a step S12, controls and/or automatically controls the internal combustion engine 3 at least with respect to the at least one function.

Figure 2:
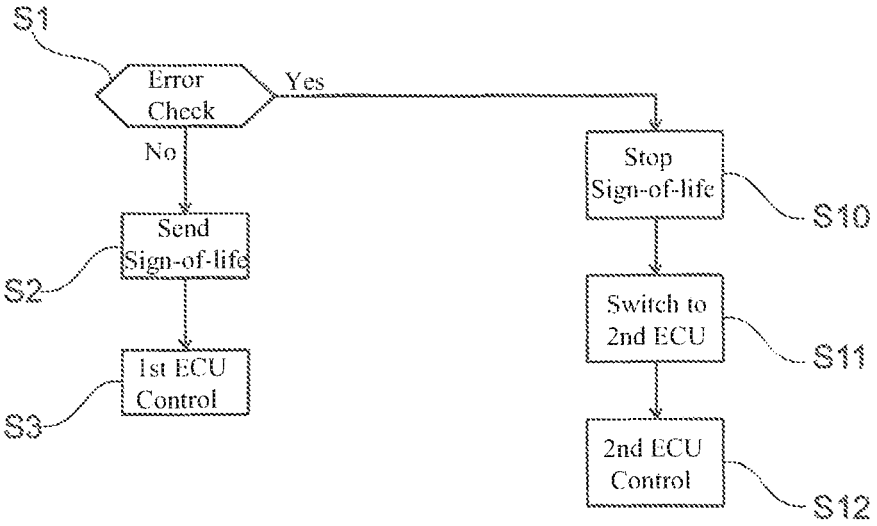
FIG. 2 shows a flow chart representing one embodiment of the method for controlling an internal combustion engine.

The method illustrated by the flow chart according to FIG. 2 is preferably carried out in exactly the same way for the second engine control unit 7, as previously explained in conjunction with the first engine control unit 5, when the at least one function of the internal combustion engine 3 is being actuated by the second engine control unit 7. For this purpose, the second engine control unit 7 also preferably generates a sign-of-life signal indicating its functionality and transmits this to the switchover device 9. If then an error or a malfunction occurs in the second engine control unit 7 or if it fails completely, the switchover device 9 can preferably switch back to the first engine control unit 5, if its functionality has been restored after only a temporary error and the sign-of-life signal of the first engine control unit 5 is again being received by the switchover device 9.

Figure 3:
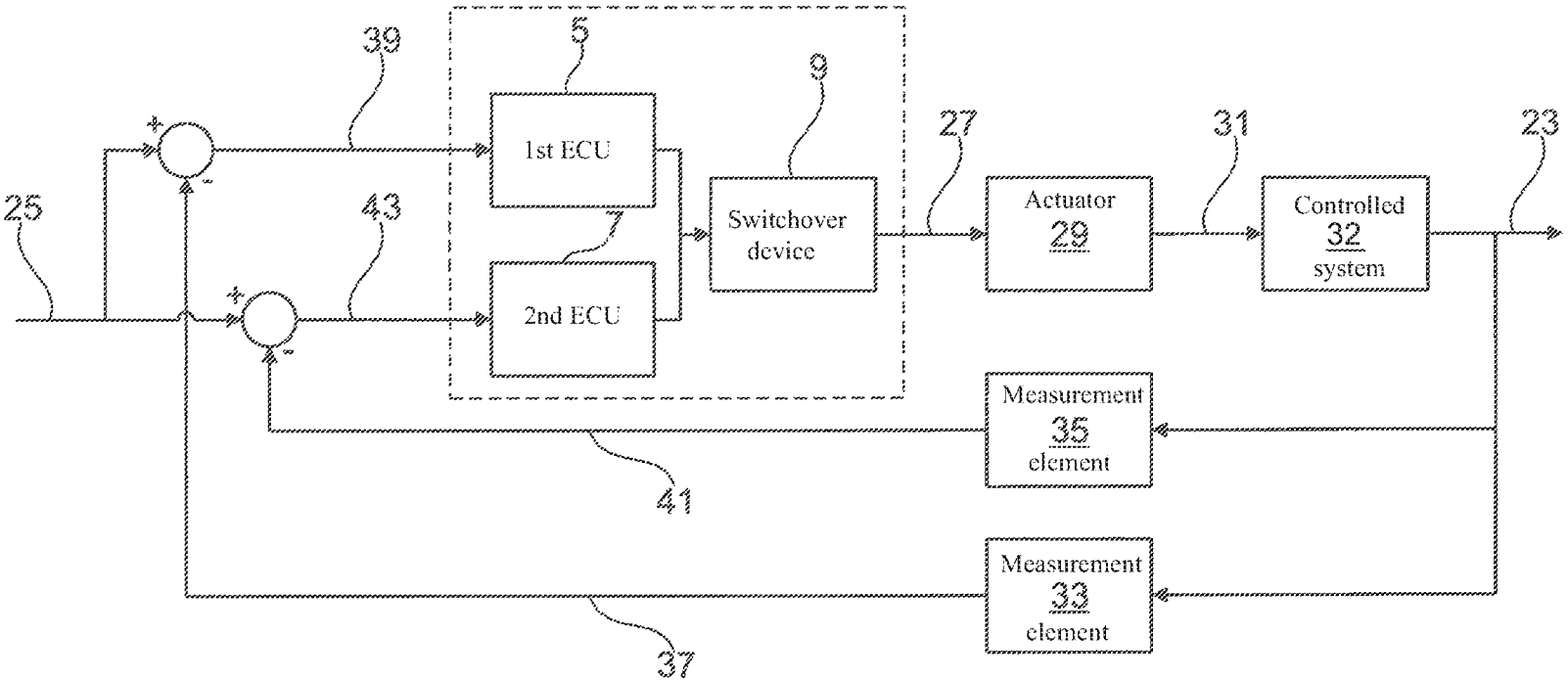
FIG. 3 shows a schematic automatic control diagram for a preferred embodiment of the method.

FIG. 3 shows a schematic automatic control diagram for a preferred embodiment of the method. Elements which are the same or which serve the same function are designated by the same reference numbers, so that to this extent reference can be made to the preceding description. The diagram according to FIG. 3 describes the redundant automatic control of a controlled variable 23 to maintain it at a nominal value 25. As redundant controllers, the first engine control unit 5 and the second engine control unit 7 are arranged in parallel. Also shown is the switchover device 9, which transmits a control quantity 27 either from the first engine control unit 5 or from the second engine control unit 7 to an actuator 29. This actuator influences a correcting variable 31, which acts on a controlled system 33.

To measure the controlled variable 23 in the embodiment of the method shown or in an exemplary embodiment of the arrangement, two independent measurement elements are provided, namely, a measurement element 33, which is assigned to the first controller or first engine control unit 5, and a second measurement element 35, which is assigned to the second controller or second engine control unit 7. A first actual value 37 of the controlled variable is compared with the nominal value 25, so that a first control deviation 39 is sent to the first controller. The second measurement element 35 determines a second actual value 41, from which, in association with the nominal value 25, a second control deviation 43 is calculated, which is sent to the second controller. It is advantageous for both the controllers and the measurement elements to be configured redundantly, because in this way it is possible again to compensate for errors, malfunctions, or complete failures of sensors by switching over to a parallel automatic control circuit.

As long as the first engine control unit 5 is active as a controller, it sees a closed controlled system, because the control quantity 27 which it generates is passed along by the switchover device 9 to the actuator 29. The second engine control unit 7, however, sees an open automatic control circuit, because there is no functional connection to the actuator 29 as long as the switchover device is passing along the control quantity 27 of the first engine control unit 5 to the actuator. This creates the problem that, over time, the integral components in the second engine control unit 7 take on values which are not usable for the automatic control of the controlled variable 23. To solve this problem, one of the previously described alternative procedures is implemented when control is switched over to the second engine control unit 7.

In a preferred embodiment of the method, the controlled quantity 23 is the rpm's of the internal combustion engine or the speed of a vehicle driven by the internal combustion engine. The actuator 29 in this case is at least one injector. Preferably all of the injectors of the internal combustion engine are used as actuators. Alternatively, the controlled quantity 23 is preferably the pressure in a high-pressure accumulator of an injection system of the internal combustion engine, in particular the automatic pressure controller for the rail of an internal combustion engine configured as a common-rail diesel engine. The actuator 29 in this case is the suction throttle on a high-pressure pump, the opening of which is varied to control the rail pressure.

Another embodiment of the method is also preferred in which the first engine control unit 5 or the second engine control unit 7 automatically control both the rpm's or the speed of the internal combustion engine and the high pressure for an injection system. In this case, the diagram according to FIG. 3 is to be, as it were, duplicated; i.e., the first engine control unit 5 and the second engine control unit 7 each generate two control quantities, namely, a first for actuating the at least one injector and a second for actuating the suction throttle. Thus separate measurement elements for the rpm's or speed on the one hand and for the high pressure on the other hand are also provided. In addition, the engine control units 5, 7 each comprise, correspondingly, two inputs for two control deviations in the two automatic control circuits.

It has been found that a switchover from the first engine control unit 5 to the second engine control unit 7 must be executed within a very short time period, preferably within a time interval of less than 100 ms, to prevent the internal combustion engine from stalling because, for example, no fuel or not enough fuel is being injected or because the pressure becomes too high. For this purpose it is necessary in particular to supply the suction throttle of the high-pressure pump with current uninterruptedly. To guarantee this, the switchover device 9 comprises preferably an anti-interrupt means.

Figure 4:
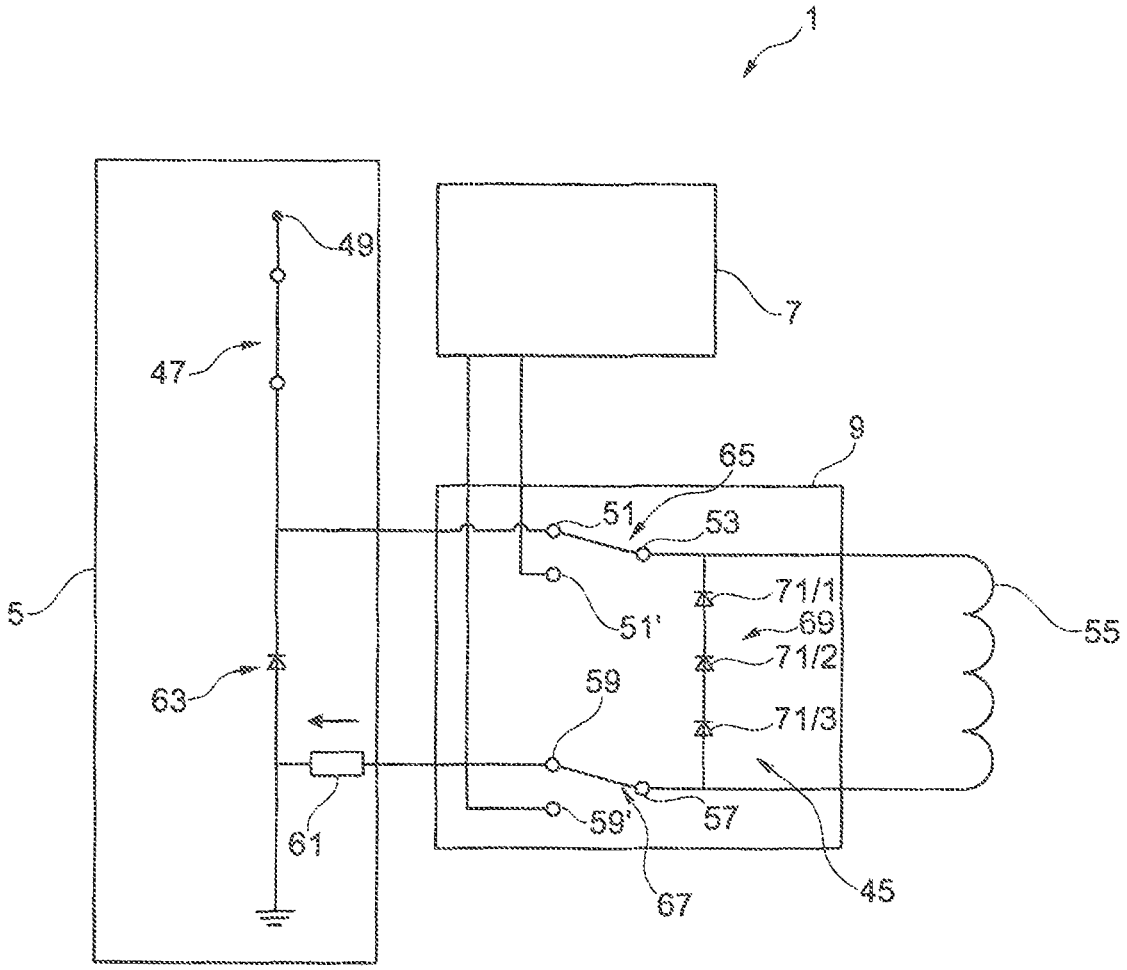
FIG. 4 shows a schematic diagram of an exemplary embodiment of an arrangement, wherein a switchover device comprises an anti-interrupt means.

FIG. 4 shows an exemplary embodiment of an arrangement 1 in which the switchover device 9 comprises such an anti-interrupt means 45. Elements which are the same or which serve the same function are designated by the same reference numbers, so that to this extent reference is made to the preceding description. The first engine control unit 5 and the second engine control unit 7 are configured identically here, so that only the structure of the first engine control unit 5 will be explained in detail. This comprises a switch 47, by which a voltage source 49 can be connected to an output 51, which is connected to a first input 53 of the switchover device 9. As the control quantity, a current flows from the voltage source 49 via the output 51 to the input 53 of the switchover device 9, which transmits it to a suction throttle (not shown) serving as an actuator 29, the opening, i.e., open cross section, of which is controlled by way of the flow of current through a coil 55. The current flows back by way of a first output 57 of the switchover device 9 to an input 59 of the first engine control unit 5. This control unit preferably comprises a measuring device 61 for measuring the current flowing through the coil 55. By means of the measuring device 61, the engine control unit 5 can also decide whether or not it is actuating the throttle valve at the time in question. This is explained in greater detail below in conjunction with the second engine control unit 7. Preferably, however, both engine control units 5, 7 detect whether or not they have the control responsibility at any particular moment, i.e., whether or not they are actuating the actuator system such as the suction throttle. To avoid excessive voltage peaks when the switch 47 is opened, i.e., when the voltage source 49 is cut off from the output 51, a flyback diode 63 is arranged between the output 51 and the input 59 in the known manner.

As previously indicated, the second engine control unit 7 has the same configuration as the first engine control unit 5.

Here in particular the measuring device 61 serves to detect whether or not the suction throttle (not shown) is being actuated by the second engine control unit 7. As long as this is not the case, an output 51' is not connected to the input 53 of the switchover device 9. Neither is an input 59' of the second engine control unit 7 connected to the output 57 of the switchover device 9. Therefore, although the voltage produced by the voltage source (not shown) of the second engine control unit 7 is present at the output 51', no current is flowing. To switch over from the first engine control unit 5 to the second engine control unit 7, the switchover device 9 comprises, in the exemplary embodiment shown here, a first switch 65 and a second switch 67. By means of the first switch 65, the connection between the output 51 an the input 53 can be cut, and a connection between the first output 51' and the input 53 can be established. In similar fashion, the second switch 67 can establish a connection between the input 59' and the output 57, whereas the connection between the input 59 and the output 57 can be cut. After the switchover has been accomplished, the current circuit of the second engine control unit 7 is closed via the output 51', the input 53, the coil 55, the output 57, and the input 59'. In this case, the measuring device of the second engine control unit 7 detects the flow of current, which is preferably greater than a previously determined threshold value. On that basis, the second engine control unit 7 recognizes that the actuation of the suction throttle has been switched over to it. The integral components of the second engine control unit 7 are then preferably initialized according to one of the previously described embodiments.

The current must continue to flow through the coil 55 preferably during the switchover from the first engine control unit 5 to the second engine control unit 7, so that the internal combustion engine does not stall or so that the pressure in the high-pressure accumulator does build up excessively. To guarantee this, the switchover device 9 comprises the anti-interrupt means 45, which is configured here as a flyback element 69. This is configured in such a way that that the current circuit remains closed across the flyback element 69; i.e., current continues to flow through the coil 55 via the flyback element 69 while the first switch 65 and the second switch 67 are actuated. The flyback element 69 preferably comprises at least one diode, here three diodes 71/1, 71/2, 71/3.

The anti-interrupt means 45 is preferably configured in such a way that it does not influence the measurement of the current by the measuring device 61 or by the corresponding measuring device in the second engine control unit 7. For this purpose, it is provided in particular that the flyback means 69 is adapted appropriately to the flyback diode 63. In the exemplary embodiment shown here, this is ensured in that three diodes 71/1, 71/2, 71/3 are used in the flyback means 69, whereas, in the first engine control unit 5, and, correspondingly also in the second engine control unit 7, only one flyback diode 63 is provided.

It has been found that the flow of current through the coil 55 correlates with the amount of fuel being delivered through the suction throttle. As a result, the flow of current influences the pressure in the high-pressure accumulator. By means of the anti-interrupt means 45, the flow of current is kept essentially constant even during the switchover, so that the pressure in the high-pressure accumulator also remains essentially constant during the switchover.

Overall it has been found that, by means of the method and the arrangement for controlling an internal combustion engine, it is easily possible to recognize whether or not an engine control unit controlling the internal combustion engine has a malfunction which puts at risk the proper operation of the engine. It is therefore possible to switch over, promptly and seamlessly, from the one engine control unit to the other without causing any relevant disturbance in the operation of the internal combustion engine, wherein the engine would stall. The method, furthermore, is uncomplicated and extremely reliable.

The invention claimed is:

1. A method for controlling an internal combustion engine, comprising the steps of: generating at least one control signal with a first engine control unit to actuate at least one function of the internal combustion engine; passing along the at least one control signal of the first engine control unit to the internal combustion engine by a switchover device for actuating the at least one function of the internal combustion engine; transmitting a sign-of-life signal indicating functionality of the first engine control unit continuously or periodically from the first engine control unit to the switchover device;

wherein the first engine control unit does not transmit the sign-of-life signal or does not transmit the signal correctly when an error occurs that puts at risk proper actuation of the at least one function of the internal combustion engine by the first engine control unit; and wherein the switchover device stops passing along the control signal of the first engine control unit to the internal combustion engine and begins passing along at least one control signal generated by a second engine control unit for actuation of the at least one function of the internal combustion engine to the internal combustion engine when the sign-of-life signal of the first engine control unit is not being received or is not being received correctly by the switchover device, wherein, during operation of the internal combustion engine, the second engine control unit continuously generates the at least one control signal, even when the control signal is not being passed along by the switchover device to the internal combustion engine.

2. The method according to claim 1, wherein the first engine control unit transmits to the second engine control unit data necessary for actuating the at least one function of the internal combustion engine a single time after or at starting of the internal combustion engine, periodically or as needed; or wherein data necessary for actuating the at least one function of the internal combustion engine are stored in the second engine control unit, and the data are called up when the actuation of the at least one function of the internal combustion engine is switched over to the second engine control unit.

3. The method according to claim 2, wherein the first engine control unit transmits the data to the second engine control unit after a change in the data.

4. The method according to claim 1, wherein the second engine control unit transmits a sign-of-life signal indicating functionality of the second engine control unit continuously or periodically to the switchover device or to the first engine control unit.

5. The method according to claim 1, wherein the second engine control unit monitors a continuously generated control signal in order to detect whether or not said second control unit is actuating the at least one function of the internal combustion engine.

6. The method according to claim 5, wherein the second engine control unit initializes parameters for the actuation of the at least one function of the internal combustion engine with stored values or releases retained values of the parameters for variation when the second engine control unit recognizes that it is actuating the at least one function of the internal combustion engine.

7. The method according to claim 5, wherein the second engine control unit generates a voltage, based on which a current flows when the second engine control unit is actuating the at least one function of the internal combustion engine, wherein no current flows when the control signal is not being passed along by the switchover device to the internal combustion engine;

wherein the second engine control unit monitors whether or not a current is flowing;

wherein the second engine control unit actuates a suction throttle; and wherein the second engine control unit monitors the current flowing from the second engine control unit through the suction throttle.

8. The method according to claim 7, wherein the second engine control unit monitors whether or not the current is exceeding a previously determined threshold value.

9. The method according to claim 7, wherein the second engine control unit continuously actuates the suction throttle.

10. The method according to claim 1, wherein the first or the second engine control unit actuates an actuator system of the internal combustion engine.

11. The method according to claim 10, wherein the actuator system includes at least one injector and/or at least one suction throttle.

12. A switchover device for use in controlling an internal combustion engine wherein the switchover device can be brought into functional connection with a first engine control unit, with a second engine control unit, and with an internal combustion engine;

wherein the switchover device is configured to pass along at least one control signal from the first engine control unit or from the second engine control unit to the internal combustion engine;

wherein the switchover device is operative to switch over from passing along the signal of the first engine control unit to passing along the signal of the second engine control unit;

wherein the switchover device is configured to receive a sign-of-life signal from the first and/or from the second engine control unit, wherein, during operation of the internal combustion engine, the second engine control unit continuously generates the at least one control signal, even when the control signal is not being passed along by the switchover device to the internal combustion engine; and wherein the switchover device is configured so as to stop passing along the at least one control signal of the first engine control unit to the internal combustion engine and starts passing along the at least one control signal of the second engine control unit to the internal combustion engine when the sign-of-life signal of the first engine control unit is not being received or is not being received correctly by the switchover device.

13. The switchover device according to claim 12, wherein the switchover device comprises at least one switch.

14. The switchover device according to claim 13, wherein the switch is a semiconductor switch or an electromechanical switch.

15. The switchover device according to claim 14, wherein the switch is a relay.

16. The switchover device according to claim 12, further comprising anti-interrupt means that permits the switchover device to continue to send at least one control signal to the internal combustion engine during a switchover between the engine control units.

17. An arrangement for controlling an internal combustion engine, comprising: a first engine control unit; a second engine control unit; and a switchover device wherein the first engine control unit and the second engine control unit are set up to generate control signals to actuate at least one function of the internal combustion engine, wherein the switchover device brings the first engine control unit and the second engine control unit into functional connection with the internal combustion engine and passes along the control signals to the internal combustion engine, wherein the first engine control unit is set up to generate and transmit a sign-of-life signal indicating functionality of the first engine control unit, wherein the first engine control unit is set up so that the sign-of-life signal is not or is not correctly generated and/or transmitted when an error occurs which puts at risk a proper actuation of the at least one function of the internal combustion engine by the first engine control unit, wherein the first engine control unit is functionally connected to the switchover device so that the sign-of-life signal is received by the switchover device, and wherein the switchover device is configured to stop passing along the at least one control signal of the first engine control unit to the internal combustion engine and to begin passing along the at least one control signal of the second engine control unit to the internal combustion engine when the sign-of-life signal of the first engine control unit is not being received or is not being correctly received by the switchover device, wherein, during operation of the internal combustion engine, the second engine control unit continuously generates the control signal, even when the control signal from the second engine control unit is not being passed along by the switchover device to the internal combustion engine.

18. An internal combustion engine comprising an arrangement according to claim 17.

19. The internal combustion engine according to claim 18, wherein the internal combustion engine is configured as a common-rail engine.

* * * * *